US008439757B2

(12) United States Patent
Hornsby et al.

(10) Patent No.: US 8,439,757 B2
(45) Date of Patent: May 14, 2013

(54) INTERACTIVE ENTERTAINMENT DEVICES INTERCHANGEABLY ARRANGABLE IN ADJACENT MANNER

(75) Inventors: James Russell Hornsby, Tampa, FL (US); Joseph L. McGowan, St. Charles, MO (US); Michael C. Reynolds, St. Louis, MO (US); Steven Fink, Cincinnati, OH (US); Robert W. Jeffway, Jr., South Deerfield, MA (US); Steven R. Casino, Fort Thomas, KY (US)

(73) Assignee: Cepia, LLC, St. Louis, MO (US)

( * ) Notice: Subject to any disclaimer, the term of this patent is extended or adjusted under 35 U.S.C. 154(b) by 60 days.

(21) Appl. No.: 13/271,660

(22) Filed: Oct. 12, 2011

(65) Prior Publication Data

US 2012/0077597 A1 Mar. 29, 2012

(51) Int. Cl.
*A63F 9/24* (2006.01)
*A63H 30/04* (2006.01)

(52) U.S. Cl.
USPC ..... 463/40; 463/1; 463/31; 463/39; 446/175

(58) Field of Classification Search ..... 446/175; 463/1, 463/39, 40
See application file for complete search history.

(56) References Cited

U.S. PATENT DOCUMENTS

| | | | | |
|---|---|---|---|---|
| 6,739,874 | B2 | 5/2004 | Marcus | 434/156 |
| 6,780,077 | B2 * | 8/2004 | Baumgartner et al. | 446/175 |
| 7,018,213 | B2 | 3/2006 | Marcus | 434/322 |
| 7,556,563 | B2 * | 7/2009 | Ellis et al. | 463/31 |
| 7,568,963 | B1 * | 8/2009 | Atsmon et al. | 446/175 |
| 7,781,979 | B2 | 8/2010 | Lys | 315/185 |
| 7,961,113 | B2 | 6/2011 | Rabiner | 340/4.21 |
| 2009/0273560 | A1 * | 11/2009 | Kalanithi et al. | 345/156 |
| 2011/0012661 | A1 | 1/2011 | Binder | 327/276 |
| 2011/0065081 | A1 | 3/2011 | Wen | 434/322 |

* cited by examiner

*Primary Examiner* — Dmitry Suhol
*Assistant Examiner* — Andrew Kim
(74) *Attorney, Agent, or Firm* — Kevin Pumm

(57) ABSTRACT

An entertainment device is configured to receive a limited range wireless signal from at least one other entertainment device when adjacently arranged in close physical proximity to at least one other entertainment device, and to responsively operate in a first mode or a second mode based on whether the other entertainment device is adjacent a first side or second side. In the first mode, the entertainment device initiates one or more wireless activation signals to control an audio/visual element of another entertainment device. In the second mode, the entertainment device receives wireless activation signals from another entertainment device to control activation of an audio/visual element of the receiving entertainment device. Each device is interchangeable between operation in the first mode of controlling at least one other entertainment device and the second mode of being controlled by another entertainment device based on position of one entertainment device relative to the other.

4 Claims, 4 Drawing Sheets

INTERACTIVE ENTERTAINMENT DEVICES INTERCHANGEABLY ARRANGABLE IN ADJACENT MANNER

FIELD

The present disclosure relates to entertainment devices, and more particularly to a system where a child arranges one or more spaced-apart entertainment devices that interact with each other.

BACKGROUND

This section provides background information related to the present disclosure which is not necessarily prior art.

Toys are known in the art for providing amusement, education and entertainment, particularly for children. One form of amusement of great interest to children is that of audio/visual stimulation. Several devices have been developed which indulge a child's interest in visual or audio stimulation. Such devices include various interconnected components that are in communication with a master controller, for controlling operation of audio or visual elements of the components. However, such devices require a physical connection between each component and the master controller, which may be too complex or difficult for use by a child.

SUMMARY

This section provides a general summary of the disclosure, and is not a comprehensive disclosure of its full scope or all of its features.

Exemplary embodiments of the present disclosure include an entertainment device that is configured to detect and interact with other duplicate entertainment devices arranged in an adjacent spaced apart manner, where the entertainment devices are configured to be interchangeably rearranged in such an adjacent spaced apart manner and still interact with each other. In the various embodiments of an arrangement of interactive entertainment devices, exemplary entertainment devices are provided that are configured to operate in a first mode of controlling at least one other entertainment device and a second mode of being controlled by at least one other entertainment device, based on a position of at least one other entertainment relative to the entertainment device.

In one exemplary embodiment, an arrangement of interactive devices is provided that includes an entertainment device configured to receive a limited range wireless signal from at least one other entertainment device when the entertainment device is adjacently arranged in close physical proximity to the at least one other entertainment device, and to responsively operate in a first mode or a second mode based on whether the at least one other entertainment device is adjacent a first side or a second side of the entertainment device. In the first mode, the entertainment device initiates one or more wireless activation signals to control activation of an audio/visual element of the least one other entertainment device. In the second mode, the entertainment device receives one or more wireless activation signals from the least one other entertainment device for controlling activation of an audio/visual element of the receiving entertainment device. The interactive entertainment device is preferably interchangeable between operation in the first mode of controlling at least one other entertainment device and the second mode of being controlled by at least one other entertainment device based on a position of the at least one other entertainment device relative to the entertainment device.

In another aspect of the present disclosure, an arrangement of interactive entertainment devices is provided that includes at least two entertainment devices. Each of the at least two entertainment devices each are configured to receive a limited range wireless signal from the other entertainment device when the entertainment devices are adjacently arranged in close physical proximity to each other. Each entertainment device is further configured to operate in a first mode of controlling the other device or a second mode of being controlled by the other device based on whether the other entertainment device is adjacent a first side or a second side of the entertainment device. Each entertainment device is configured to operate in the first mode by initiating one or more wireless activation signals to control activation of an audio/visual element of at least one other entertainment device. Similarly, each entertainment device is configured to operate in the second mode when receiving one or more wireless activation signals for controlling an audio/visual element from at least one other entertainment device. The at least two entertainment devices are each interchangeable between operation in the first mode of controlling at least one other entertainment device and the second mode of being controlled by at least one other entertainment device, based on the position of the at least two entertainment devices relative to each other.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 5:
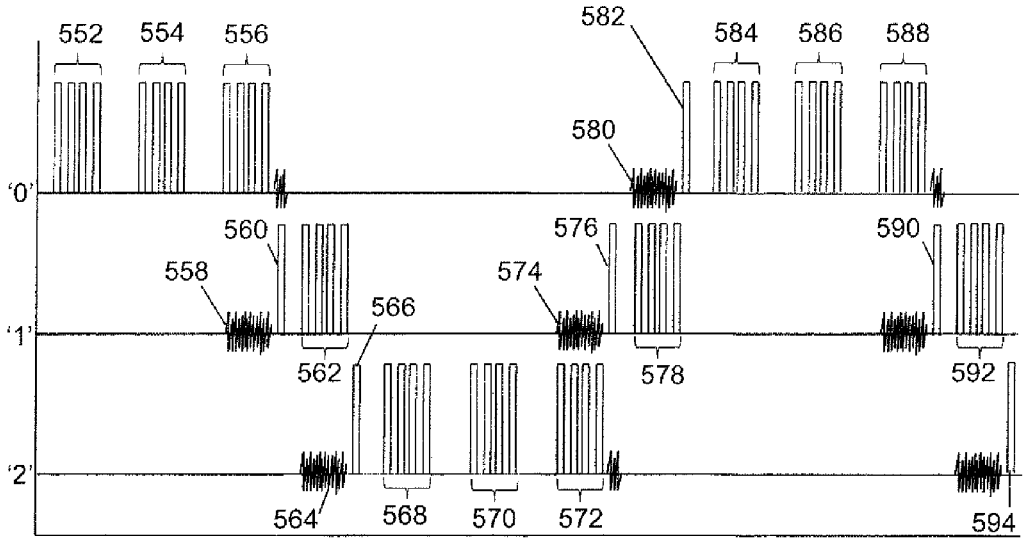
Figure 6:
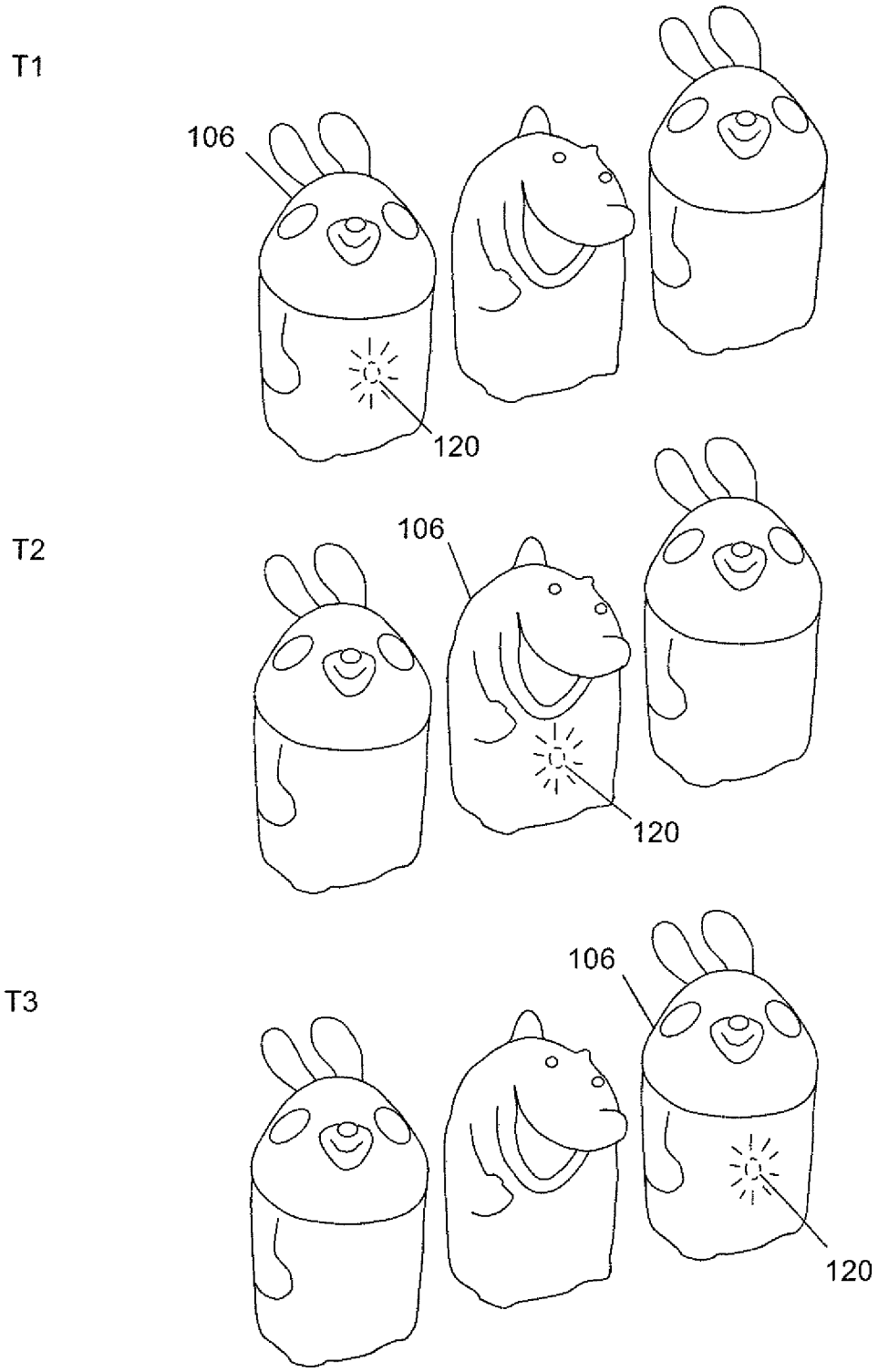

FIG. 5 is a representation of an oscilloscope output illustrating operation and signal transmission of an arrangement of three or more interactive entertainment devices, according to one embodiment of the present disclosure; and FIG. 6 is a top perspective view of an arrangement of interactive entertainment devices according to one embodiment of the present disclosure, in accordance with the principles of the present disclosure.

Corresponding reference numerals indicate corresponding parts throughout the several views of the drawings.

DETAILED DESCRIPTION

The following description is merely exemplary in nature and is not intended to limit the present disclosure, application, or uses. It should be understood that throughout the drawings, corresponding reference numerals indicate like or corresponding parts and features. Example embodiments will now be described more fully with reference to the accompanying drawings.

Exemplary embodiments of the present disclosure include an entertainment device that is configured to detect and interact with other duplicate entertainment devices arranged in an adjacent spaced-apart manner, where the entertainment devices are configured to be interchangeably rearranged in such an adjacent spaced apart manner and still interact with each other. In the various embodiments of an interactive entertainment device arrangement, exemplary entertainment devices are provided that are configured to operate in a first mode of controlling at least one other entertainment device and a second mode of being controlled by at least one other entertainment device, based on a position of one entertainment relative to the other entertainment device.

In one exemplary embodiment, an arrangement of interactive devices is provided that includes an entertainment device configured to receive a limited range wireless signal from at least one other duplicate entertainment device when the entertainment device is adjacently arranged in close physical proximity to at least one other entertainment device, and to responsively operate in a first or second mode based on whether the at least one other entertainment device is to adjacent a first side or a second side of the entertainment device. In the first mode, the entertainment device initiates one or more wireless activation signals to control activation of an audio/visual element of the least one other entertainment device. In the second mode, the entertainment device receives one or more wireless activation signals from the least one other entertainment device for controlling activation of an audio/visual element of the receiving entertainment device. The interactive entertainment device is preferably interchangeable between operation in the first mode of controlling at least one other entertainment device and the second mode of being controlled by at least one other entertainment device based on a position of the at least one other entertainment device relative to the entertainment device.

In another aspect of the present disclosure, an arrangement of entertainment devices is provided that includes at least two entertainment devices. Each of the at least two entertainment devices each are configured to receive a limited range wireless signal from the other entertainment device when the entertainment devices are in close physical proximity to each other. Each entertainment device is further configured to operate in a first mode of controlling the other device or a second mode of being controlled by the other device based on whether the other entertainment device is adjacent a first side or a second side of the entertainment device. Each entertainment device is configured to operate in the first mode by initiating one or more wireless activation signals to control activation of an audio/visual element of at least one other entertainment device. Similarly, each entertainment device is configured to operate in the second mode when receiving one or more wireless activation signals for controlling an audio/visual element from at least one other entertainment device. Each of the entertainment devices may interchangeably operate in a first mode of controlling at least one other entertainment device and a second mode of being controlled by at least one other entertainment device based on position. For example, each entertainment device may operate in the first mode while in a left-most position relative to other entertainment devices. Alternatively, the entertainment device may operate in the first mode while in a right-most position.

Figure 1:
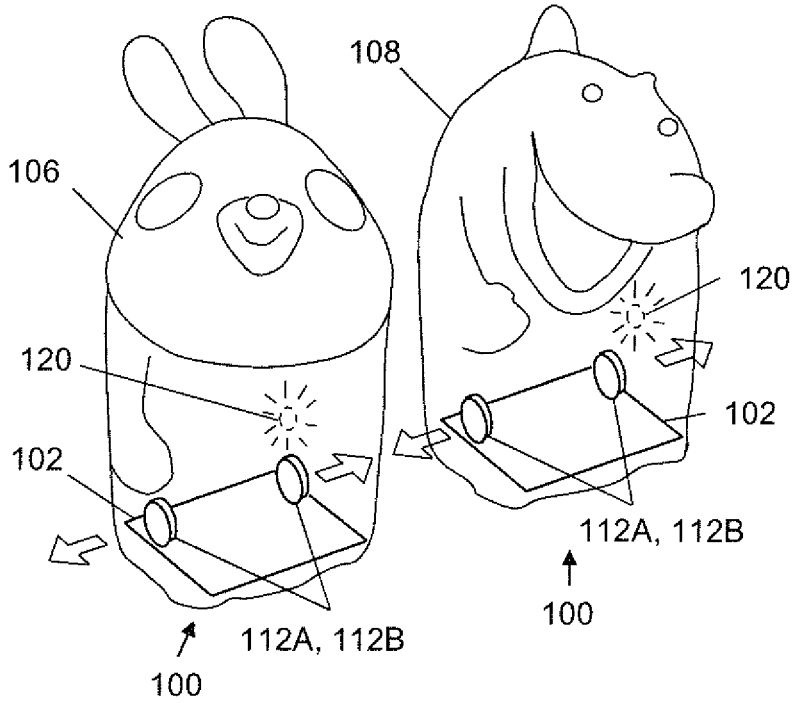
FIG. 1 is a top perspective view of an arrangement of interactive entertainment devices according to one embodiment of the present disclosure.

Referring to FIG. 1, a first embodiment of an arrangement of entertainment devices is shown generally at 100. The arrangement includes one or more entertainment devices 100, which may each be embellished to provide one or more visually distinct entertainment devices 106, 108 (or characters). Each entertainment device 106, 108 may include an opening or access panel 102, and a communication device 112A, 112B within the interior of the entertainment device 106, 108. Each communication device 112A, 112B of entertainment device 106 is configured to receive a limited range wireless signal from at least one other entertainment device (e.g. 108) when the entertainment device 106 is in close physical proximity to the at least one other entertainment device (e.g., 108). The entertainment device 106 will responsively operate in a first mode or a second mode based on whether the at least one other entertainment device (e.g., 108) is adjacent a first side or a second side of the entertainment device 106. In the first mode, the entertainment device 106 initiates one or more wireless activation signals to control activation of an audio/visual element 120 of the at least one other entertainment device 108 adjacent its first side, as shown in FIG. 1. In the second mode, an entertainment device (e.g., 108) is configured to receive one or more wireless activation signals from at least one other entertainment device adjacent its second side (e.g., 106), to control activation of an audio/visual element 120 of the receiving entertainment device (e.g., 108). Each interactive entertainment device 106 and 108 may be interchangeably rearranged and positioned in a spaced-apart adjacent manner relative to each other and still interact with each other. The entertainment devices 106, 108 are also interchangeable between operation in a first mode of controlling at least one other entertainment device and a second mode of being controlled by at least one other entertainment device, based on a position of the at least one other entertainment device relative to the entertainment device (e.g., which side of the entertainment device the other entertainment device is on).

Figure 2:
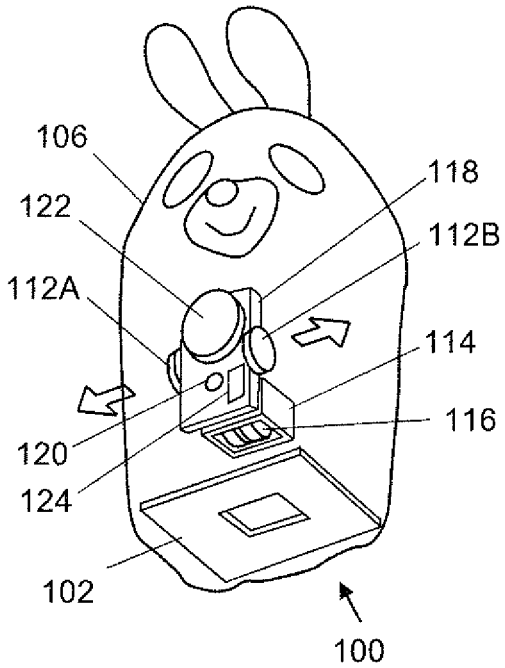
FIG. 2 is a bottom perspective view of one embodiment of an entertainment device in accordance with the present disclosure.

Referring to FIG. 2, an exemplary construction of one embodiment of an entertainment device 106 is shown. The entertainment device includes a base or access panel 102 and one or more components within the interior of the entertainment device 106. The entertainment device 106 may be battery powered, and may include a battery compartment 114 having one or more batteries 116 therein. The entertainment device 106 preferably includes a circuit board 118 that the battery compartment 114 and batteries 116 are coupled or connected to. Connected to the circuit board 118 is an audio/visual element that may comprise a speaker 122, or a light emitting device 120 that may be an incandescent lamp, fluorescent lamp, a semiconductor device or light emitting diode (LED). The entertainment device 106 may further include a microprocessor 124 in connection with one or more communication devices 112A, 112B configured to receive a limited range wireless signal from at least one other entertainment device, as explained below.

Figure 3:
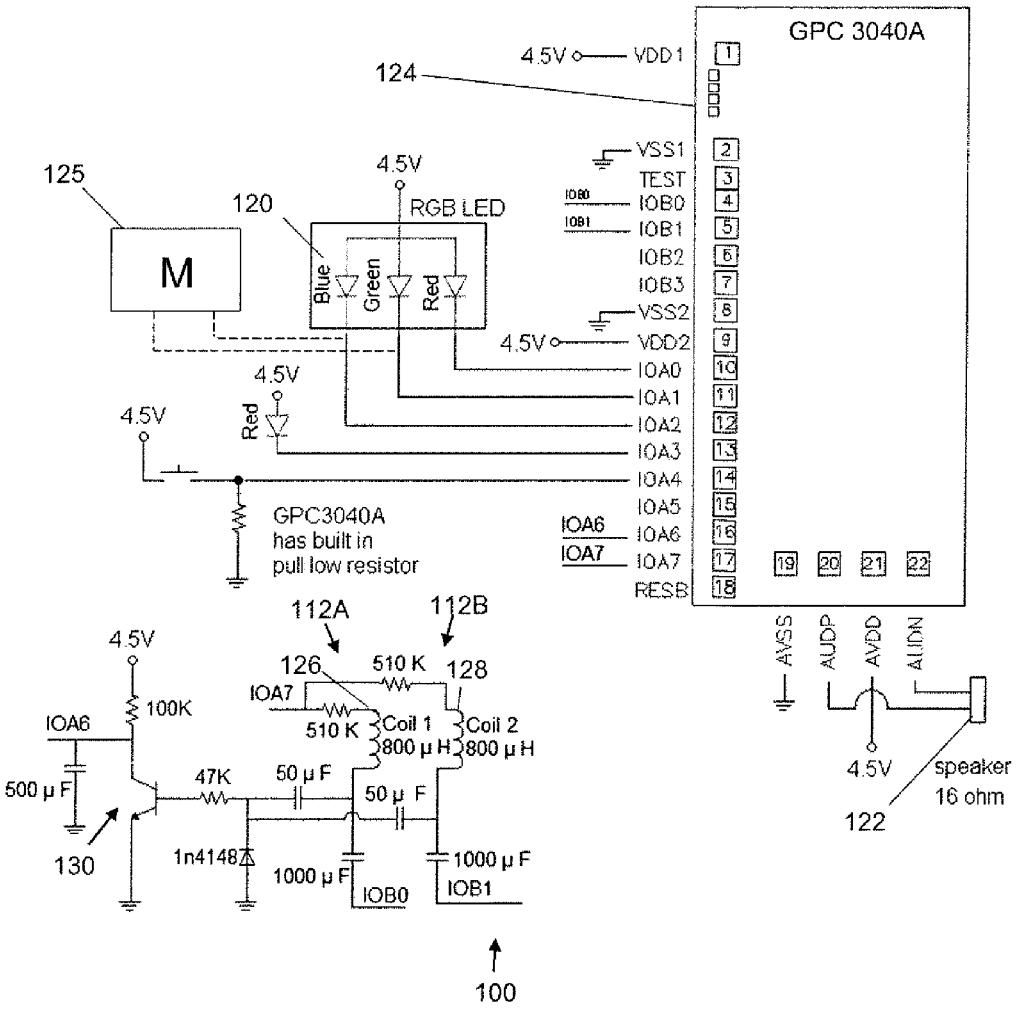
FIG. 3 is a schematic diagram of one embodiment of an entertainment device.

Referring to FIG. 3, an exemplary schematic diagram of one embodiment of an entertainment device 106 is shown. The entertainment device 106 may be battery powered, and may include one or more batteries 116 (FIG. 2) that provide a direct current voltage of 4.5 volts for supplying power to the microprocessor 124 and other components associated with the circuit or circuit board 118 (FIG. 2). The microprocessor 124 is preferably coupled or connected to one or more audio/visual elements, such as a red, green and blue light emitting diode (RGB LED) 120 and a speaker 122, as shown in FIG. 3. The microprocessor 124 may be, for example, a GBC 3040A microprocessor manufactured by Generalplus Technology Inc. The microprocessor 124 preferably has one or more input/output pins IOA6, IOA6, IOB0 and IOB1 that are coupled or connected to the communication devices 112A, 112B for configuring and enabling the entertainment device to transmit signals to and receive signals from at least one other entertainment device, as explained below.

The various embodiments of an entertainment device (e.g., 106, 108) include communication devices 112A, 112B that are configured to transmit and receive limited range wireless signals (e.g., 0 to 2 inches) to another device. Examples of communication devices capable of transmitting and receiving limited range wireless signals may include infrared transmitter and receiver devices, light emitting devices and optical sensors, hall effect sensors, a magnet coupling, an inductive field coupling, or radio frequency RF transmitters and receivers and other equivalent wireless communication means suitable for limited range transmission and reception.

For example, the communication device 112A, 1128 may comprise an antenna coupled to a receiver chip (not shown) for decoding low power radio frequency transmissions received from another entertainment device (e.g. 108). The microprocessor 124 in connection with such a receiver chip may be configured to compare a received signal to a type code or reference frequency, and to demodulate the signal into a digital data stream to acquire a header or other data that may include information as to the origination source of the received signal. Similarly, infrared transmitters and receivers may be used to communicate limited range signals for processing by microprocessor 124.

In the schematic illustration embodied and shown in FIG. 3, the entertainment device 106 includes communication devices 112A, 112B that utilize an inductive coupling to transmit signals. The communication devices 112A, 112B may include first and second spaced apart receiving elements 126, 128, or inductive elements, which are configured to separately receive a signal from an adjacent entertainment device in close proximity thereto (e.g., between 0.01 inch and 1.0 inch). The inductive elements may be coils 126, 128 (e.g., 250 turn coils) that are each configured to receive a limited range wireless signal from a single transmitting source of at least one other entertainment device in close proximity. When at least one other entertainment device (e.g., 108) initiates a transmission while adjacent to the entertainment device 106, a limited range magnetic field (800 μHenry) is generated that induces current in the closest of the coils or inductive elements 126, 128, where the induced current represents a wireless signal received from at least one other entertainment device (e.g, 108). For example, microprocessor 124 may switch pin IOB1 to high impedance and switch pin IOB0 low to enable current induced in the left coil 126 to gate transistor 130 on and off to provide an output representative of a received signal to pin IOA6. Microprocessor 124 may also switch pin IOB0 to high impedance and switch pin IOB1 low to enable current induced in the right coil 128 to gate transistor 130 on and off to output a signal received on the device's right side to pin IOA6. Similarly, microprocessor 124 may switch pin IOB1 to high impedance and switch pin IOB0 low to input a carrier in the left coil 126 to transmit a signal from the left side of the device 106, or switch pin IOB0 to high impedance and switch pin IOB1 low to input a carrier in the right coil 126 to transmit a signal from the right side of the device 106. Thus, the coils or inductive elements 126 are each configured to conduct a current and generate a magnetic field that is capable of inducing a current in the coil or inductive element (e.g., 126, 128) of another entertainment device (e.g., 108), to thereby transmit a limited range wireless signal. The current signal may be processed as a serial bit stream signal from the communication device 112A, 112B and output to an input port pin IOA6 on the microprocessor 124. The microprocessor 124 may, for example, be configured to load the signal data into a buffer for processing, and configured to strip the data or analyze a header bit at the beginning of the signal to analyze or synchronize the signal for identifying a unique bit number within the data to verify signal protocol with various command signals. Accordingly, the microprocessor 124 may be configured or programmed to receive and process a signal received from at least one other entertainment device. The microprocessor 124 may be configured to respond to the receipt (or lack of receipt) of a limited range wireless signal by interchangeably switching between operation in a first mode of controlling at least one other entertainment device and a second mode of being controlled by another entertainment device, based on the position of the entertainment devices relative to each other, as explained below.

Figure 4:
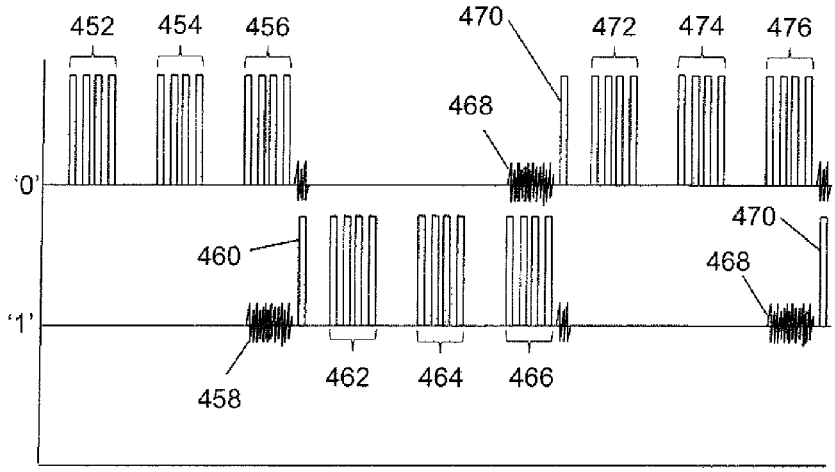
FIG. 4 is a representation of an oscilloscope output illustrating operation and signal transmission of an arrangement of two or more interactive entertainment devices, according to one embodiment of the present disclosure.

Referring to FIG. 4, a representation of an oscilloscope output is shown illustrating the signal operation of two entertainment devices 106, 108 that are each configured to receive a limited range wireless signal from another entertainment device, and to interchangeably operate in either a first mode of controlling at least one other entertainment device (e.g., 108 in FIG. 1) and a second mode of being controlled by at least one other entertainment device (e.g., 106 in FIG. 1). The signal data for the left most entertainment device (e.g. 106 shown in FIG. 1) is illustrated along the first line '0' and the signal data for the at least one other entertainment device (e.g. 108 in FIG. 1) is illustrated along the second line labeled '1.' The entertainment devices are configured to inquire as to the presence of another entertainment device in close proximity thereto by transmission of one or more 'polling' signals, as explained below.

When initially separated or isolated from other entertainment devices, entertainment device 106 (shown in FIG. 1) is configured to controllably switch on and off a coil (e.g., coil 126 or 128) to generate a series of pulses for sending a limited range wireless signal for 'polling' another entertainment device. As shown in FIG. 4, the entertainment device 106 is configured to send (via coil 126 in FIG. 3) at least one limited range wireless signal 452 for 'polling' left to determine if another entertainment device (e.g., device 108 in FIG. 1) is to its left. It should be noted that the 'polling' signal generated by each entertainment device does not require any code or information for uniquely identifying itself or other specific entertainment devices. It should be noted that the various embodiments of an entertainment device could be configured to generate a 'polling' signal by activating only one particular coil or by simultaneously activating both coils 126, 128 (in FIG. 3), where one or more bits within the signal may be changed to identify two simultaneously transmitted signals as polling 'left' or polling 'right' for determining the presence of another device on a given side. Additionally, the entertainment device 106 may, for purposes of signal reliability, transmit a second limited range wireless signal 454 for 'polling' left. The 'polling' left signals may comprise a signal having, for example, the following bit sequence:

Polling left signal bit sequence [0000 0011 0000 1100]

When no response signal is received by the entertainment device 106 (via coil or inductive element 126) in response to the polling left signals 452, 454, the entertainment device 106 preferably transmits a limited range wireless signal 456 for polling 'right,' which may have a different bit sequence, as shown below:

Polling right signal bit sequence [0001 0000 0000 1111]

As shown at line '1' in FIG. 4, the signal portion 458 represents the receipt of the polling 'right' signal 456 by the at least one other entertainment device (e.g., 108 that is positioned in close proximity to the right of entertainment device 106 in FIG. 1). The at least one other entertainment device (e.g., 108) switches its configuration or state to operate in a second mode of being controlled by another entertainment device (e.g., 106 in FIG. 1). The at least one other entertainment device also transmits a limited range wireless signal 460 acknowledging the signal 456 polling 'right.' At that point, the left-most entertainment device (e.g. 106 in FIG. 1) is presently configured to operate in a first mode of controlling the at least one other entertainment device (e.g., device 108 in FIG. 1).

As shown at line '1' in FIG. 4, the at least one other entertainment device (e.g., 108 in FIG. 1) generates one or more downstream transmissions for polling 'right' to determine if additional entertainment devices are in close proximity to its right side. Upon switching to operation in the first mode of being controlled by another entertainment device (e.g., 106), the at least one other entertainment device (e.g., 108 in FIG. 1) transmits a first limited range wireless signal 462 and a second redundant limited range wireless signal 464 for polling 'right' to inquire if another entertainment device is in close proximity to its right side. At least one bit within these polling signals may be incremented to indicate that the at least one other entertainment device (e.g., 108 in FIG. 1) has assigned itself as the first controlled entertainment device within a chain of one or more entertainment devices. If no acknowledgment signal is received, the at least one other entertainment device (e.g., 108 in FIG. 1) transmits a limited range wireless signal 466 to the first entertainment device (e.g., 106) that serves as a response signal for reporting that there is only a first controlled entertainment device assigned to the controlling entertainment device.

As shown at line '0' in FIG. 4, the signal portion 468 represents the receipt by the left-most entertainment device (e.g. 106) of the response signal from the at least one other entertainment device (e.g., 108). The left-most entertainment device transmits a limited range wireless signal 470 to provide acknowledgement to the at least one other entertainment device (e.g., 108) and then transmits two limited range wireless signals 472, 474 for polling 'left' to verify that there are no entertainment devices to its left before initiating transmission of an limited range wireless 'activation' signal 476 to the at least one other entertainment device (e.g., 108). The activation signal controls activation of an audio/visual device of at least one entertainment device (108), and may include an instruction to at least one other entertainment device (e.g., 108) to turn on a light emitting diode (LED) or to pulse a speaker to generate an audio output at a given frequency. The activation signal may be distinguished from other signals by a different bit sequence as in the example below;

Activation signal bit sequence [0000 0001 1111 1110]

The at least one other entertainment device (e.g., 108 in FIG. 1) transmits a limited range wireless signal to the left most entertainment device (e.g., 106) to acknowledge receipt of the 'activation' signal, and responsively controls activation of its light emitting device 120 or speaker 122 as instructed.

Accordingly, at least two entertainment devices 106 and 108 are provided as shown in FIG. 1, which each are configured to receive a limited range wireless signal from the other entertainment device when the entertainment devices are in close proximity to each other. Each entertainment device is configured to operate in a first mode of controlling another entertainment device or a second mode of being controlled by another entertainment device based on whether the other entertainment device is adjacent a first side or a second side of the entertainment device. Each entertainment device is configured to operate in the first mode by initiating one or more wireless signals (e.g., signal 476) to control activation of an audio/visual element of at least one entertainment device. Each entertainment device is configured to operate in the second mode when receiving one or more wireless activation signals (e.g., signal 476) for controlling an audio/visual element of the at least one other entertainment device.

According to another aspect of the present disclosure, an arrangement of three or more spaced apart (e.g., 0.01 to 1.0 inch) adjacently arranged entertainment devices are provided as shown in FIG. 6, which can generate visual display effects or sound effects by controlling a timing sequence for activating audio/visual elements of each of the entertainment devices. In this embodiment of an arrangement of interactive devices, the three or more entertainment devices 106, 108 and 110 are configured to interact to generate one or more visual outputs for creating a display effect, or to generate one or more audio outputs for playing a song, as explained below.

Referring to FIG. 5, a representation of an oscilloscope output is shown illustrating the signal operation of three entertainment devices 106, 108 and 110 that are each configured to receive a limited range wireless signal from another entertainment device, and to interchangeably operate in either a first mode of controlling at least one other entertainment device (e.g., 108, 110 in FIG. 6) and a second mode of being controlled by at least one other entertainment device (e.g., 106 in FIG. 6). The signal data for the left most entertainment device (e.g., 106 shown in FIG. 6) is illustrated along the first line '0,' the signal data for the second entertainment device (e.g., 108 in FIG. 6) is illustrated along the second line labeled '1,' and the signal data for the third entertainment device (e.g., 110 in FIG. 6) is illustrated along the third line labeled '2.' The various embodiments of an entertainment device are configured to inquire as to the presence of at least one other entertainment device in close proximity thereto by transmission of one or more 'polling' signals, as explained below.

As shown in FIG. 5, the left most entertainment device 106 (shown in FIG. 6) is configured to controllably switch on and off a coil (e.g., coil 126, 128 in FIG. 3) to generate a series of pulses for sending a limited range wireless signal for 'polling' other entertainment devices. As shown in FIG. 5, the entertainment device 106 is configured to send (via coil 126 in FIG. 3) at least one limited range wireless signal 552 for 'polling' left to inquire if an entertainment device is to its left. Additionally, the entertainment device 106 may for reliability purposes transmit a second limited range wireless signal 554 for 'polling' left. The 'polling' left signals may comprise a signal having, for example, the following bit sequence:

Polling left signal bit sequence [0000 0011 0000 1100]

When no response signal is received by the entertainment device 106 (via coil or inductive element 126 in FIG. 3) in response to the polling left signals 552, 554, the entertainment device 106 (in FIG. 6) transmits a limited range wireless signal 556 for polling 'right,' which may have a different bit sequence, as shown below:

Polling right signal bit sequence [0001 0000 0000 1111]

As shown at line '1' in FIG. 5, the signal portion 558 represents the receipt of the polling 'right' signal 556 by the second entertainment device (e.g., 108 that is positioned in close proximity to the right of entertainment device 106 in FIG. 6). The second entertainment device (e.g., 108) switches its configuration or state to operate in a second mode of being controlled by another entertainment device (e.g., 106 in FIG. 6). The second entertainment device (e.g., 108 in FIG. 6) also transmits a limited range wireless signal 560 acknowledging the signal 556 polling 'right.' At this point, the left most entertainment device (e.g. 106) is presently configured to operate in a first mode of controlling at least the second entertainment device (e.g., 108 in FIG. 6).

As shown at line '1' in FIG. 5, the second entertainment device (e.g., 108 in FIG. 6) generates a transmission 562 for polling 'right' to determine if additional entertainment devices are in close proximity to its right side. Upon switching to operation in the first mode of being controlled by another entertainment device (e.g., 106 in FIG. 6), the second entertainment device (e.g., 108 in FIG. 6) transmits a first limited range wireless signal 562 for polling 'right' to inquire if another entertainment device is in close proximity to its right side. At least one bit within these polling signals may be incremented to indicate that the at least one other entertainment device (e.g., 108 in FIG. 6) has assigned itself as the first controlled entertainment device within a chain of one or more entertainment devices.

As shown at line '2' in FIG. 5, the signal portion 564 represents the receipt of the polling 'right' signal 556 by the third entertainment device (e.g., 110 that is positioned in close proximity to the right of entertainment device 108 in FIG. 6). The third entertainment device (e.g., 110) changes its configuration or state to operate in a second mode of being controlled by another entertainment device (e.g., 106 in FIG. 6). The third entertainment device (e.g., 110 in FIG. 6) transmits a limited range wireless signal 566 acknowledging the signal 562 polling 'right.'

As shown at line '2' in FIG. 5, the third entertainment device (e.g., 110 in FIG. 6) generates a downstream transmission for polling 'right' to determine if additional entertainment devices are in close proximity to its right side. Upon switching to operation in the first mode of being controlled by another entertainment device (e.g., 106 in FIG. 6), the third entertainment device (e.g., 108 in FIG. 6) transmits a first limited range wireless signal 568 and a second limited range wireless signal 570 for polling 'right' to inquire if another entertainment device is in close proximity to its right side. At least one bit within these polling signals may be incremented to indicate that the at least one other entertainment device (e.g., 110 in FIG. 6) has assigned itself as the second controlled entertainment device within a chain of one or more devices. If no acknowledgment signal is received, the third entertainment device (e.g., 110 in FIG. 6) transmits a limited range wireless signal 572 to the second entertainment device (e.g., 108) that serves as a response signal for reporting that a second controlled entertainment device 110 is present and no further entertainment devices are assigned to the controlling entertainment device (e.g., 106 in FIG. 6).

As shown at line 1' in FIG. 5, the signal portion 574 represents the receipt by the second entertainment device (e.g. 108) of the response signal from the third entertainment device (e.g., 110). The second entertainment device 108 transmits a limited range wireless signal 576 to provide acknowledgement to the third entertainment device (e.g., 110) and then the second entertainment device (e.g., 108 in FIG. 6) transmits a limited range wireless signal 578 to the left most entertainment device (e.g., 106) that serves as a response signal for reporting that there are first and second controlled entertainment devices (108 and 110 in FIG. 6) and no other entertainment device thereafter.

As shown at line '0' in FIG. 5, the signal portion 580 represents the receipt by the left-most entertainment device (e.g. 106 in FIG. 6) of the response signal from the second entertainment device (e.g., 108). The left-most entertainment device transmits a limited range wireless signal 582 to provide acknowledgement to the second entertainment device (e.g., 108) and then transmits two limited range wireless signals 584, 586 for polling 'left' to verify that there are no entertainment devices to its left before initiating transmission of an limited range wireless 'activation' signal 588 to the second entertainment device (e.g., 108) for controlling activation of an audio/visual element of the second entertainment device (e.g., 108). The second entertainment device (e.g., 108 in FIG. 6) transmits a limited range wireless signal 590 to the left most entertainment device (e.g., 106) to acknowledge receipt of the 'activation' signal, and then responsively controls activation of its light emitting device 120 or speaker 122 as instructed. The second entertainment device (e.g., 108 in FIG. 6) also generates a downstream wireless 'activation' signal 592 to control activation of an audio/visual element of the third entertainment device (e.g., 110). The 'activation' signal could include an instruction to the second and third entertainment devices (e.g., 108, 110) to turn on a light emitting diode (LED) or to pulse a speaker to generate an audio output at a given frequency. The third entertainment device (e.g., 110 in FIG. 6) transmits a limited range wireless signal 594 to the second entertainment device (e.g., 108) to acknowledge receipt of the 'activation' signal, and responsively controls activation of its light emitting device 120 or speaker 122 as instructed. It should also be noted that, instead of light emitting device 120, an LCD display 125 (FIG. 3) may be used to display a color, or segments that form an alpha-numeric character or letter of a word.

Accordingly, at least three interactive entertainment devices may be arranged as shown in FIG. 6, where the left-most entertainment device 106 is configured to operate in a first mode for controlling the second and third entertainment devices 108, 110, and the second and third entertainment devices 108, 110 are each configured to operate in a second mode of being controlled by one or more activation signals initiated by the left-most entertainment device 106. In this arrangement, the left-most entertainment device 106 is configured to transmit activation signals to control the second and third entertainment devices to generate a visual display effect, such as that of controllably activating the light emitting device of each entertainment device in a successive sequence as depicted in FIG. 6. The left-most entertainment device 106 is configured to transmit activation signals for controlling at least the second and third entertainment devices, and to control the timing for activation of a light emitting device of the second and third entertainment devices for generating various lighting patterns or outputs over time (T1, T2 and T3) as shown in FIG. 6. The lighting pattern may represent a moving light traveling across a plurality of entertainment devices. Similarly, the lighting pattern may travel across a row of entertainment devices and back, so as to bounce back and forth between a row of entertainment devices. Accordingly, the left-most entertainment device is operable in a first mode of controlling other entertainment devices and configured to initiate activation signals to control activation of its display or light emitting device and a display or light emitting device of at least one other entertainment device according to a timing sequence for generating a blinking light pattern. It should be noted that each entertainment device (when operating in a first mode) is configured to initiate activation signals to control activation of its audio/visual element and an audio/visual element of at least one other entertainment device, without prompting or actuation of a user-input button by a user. It should also be noted that the audio/visual element may alternatively include an LCD display 125 (as in FIG. 3), wherein each entertainment device may be configured to generate a particular color output, or to turn on one or more display segments to display an alpha-numeric character for forming individual letters of a word, for example.

According to another aspect of the present disclosure, the left-most entertainment device may also be configured to transmit activation signals to control the second and third entertainment devices to generate an audio output, such as that of a sound emitted from a speaker. The sound emitted may be a song or a melody, or a word, phrase or a sentence. Thus, instead of activating a light 120, the left-most entertainment device 106 in the arrangement of interactive devices 106, 108 and 110 in FIG. 6 may be configured to control a speaker in each entertainment device and to sequentially activate each speaker over time to play a melody such as "Mary Had A Little Lamb," for example.

Additionally, where each entertainment device includes a speaker, the entertainment device that is operable in the first mode of controlling at least one other entertainment device may be configured to play an audible script for creating an appearance of a conversation with at least one other entertainment device. For example, when the second entertainment device 108 is positioned adjacent to the first entertainment device 106 as shown in FIG. 6, the first entertainment device 106 operable in the first mode may play a script to cause the speaker to output a "Hello" sound, for creating an appearance of a conversation with the second entertainment device 108. Similarly, when the third entertainment device 110 is positioned adjacent to the second entertainment device 108 as shown in FIG. 6, the third entertainment device 110 would establish operation in the second mode and play a script to cause the speaker to output a "Excuse me," "Hi there," or "Bonk" sound. It should be noted that each entertainment device 106 may alternatively activate a motor or electromagnet (not shown) for causing animated movement to generate a visual effect. Thus, the interactive arrangement of entertainment devices are configured to generate various audio/visual effects to indulge a child's interest in audio/visual stimulation.

In view of the above disclosure, various embodiments of an arrangement of interactive devices are provided in which each entertainment device is operable in a first mode to transmit activation signals when the at least one other entertainment device is adjacent a first right side of the entertainment device. In this configuration, each entertainment device is operable in the second mode to receive activation signals when at least one other entertainment device is adjacent a second left side of the entertainment device. Likewise, each entertainment device is configured to transmit a wireless polling signal intended for at least one other entertainment device and to initiate operation in the first mode upon receiving a wireless signal from at least one other entertainment device indicating that at least one other entertainment device is adjacent a right side of the entertainment device. Each entertainment device is also configured to initiate operation in the second mode upon receiving a wireless polling signal from at least one other entertainment device indicating that at least one other entertainment device is adjacent a left side of the entertainment device.

It should be noted that the above described arrangements of interactive entertainment devices 106, 108 and 110 may be reconfigured to transmit polling signals in an opposite direction to that described above, such that the right-most entertainment device is operable in a first mode of controlling other entertainment devices that are operable in a second mode of being controlled by the right-most entertainment device. For example, each entertainment device 106, 108 and 110 may be operable in a first mode to control at least one other entertainment device when at least one other entertainment device (e.g., 106, 108) is adjacent a first left side of the entertainment device (e.g., 110). In such a configuration, each entertainment device may be configured to transmit activation signals when at least one other entertainment device is adjacent a first left side of the entertainment device. In this configuration, each entertainment device is operable in the second mode to receive activation signals when at least one other entertainment device is adjacent a second right side of the entertainment device. Likewise, each entertainment device is configured to transmit a wireless polling signal intended for at least one other entertainment device and to initiate operation in the first mode upon receiving a wireless signal from at least one other entertainment device indicating that at least one other entertainment device is adjacent a right side of the entertainment device. Each entertainment device is further configured to initiate operation in the second mode upon receiving a wireless polling signal from at least one other entertainment device indicating that another entertainment device is adjacent a left side of the entertainment device.

Alternatively, the exemplary entertainment devices 106, 108 and 110, may be reconfigured to transmit polling signals in a vertical direction that is different from the directions described above. In such a configuration, the entertainment device may be operable in a first mode to transmit activation signals when the least one other entertainment device is adjacent a first upper side of the entertainment device. In this alternate configuration, the entertainment device is operable in the second mode to receive activation signals when the least one other entertainment device is adjacent a second lower side of the entertainment device. In this vertical arrangement, each entertainment device is configured to transmit a wireless polling signal intended for at least one other entertainment device and to initiate operation in the first mode upon receiving a wireless signal from at least one other entertainment device indicating that another entertainment device is adjacent a first upper side of the entertainment device. Each entertainment device is further configured to initiate operation in the second mode upon receiving a wireless polling signal from at least one other entertainment device indicating that at least one other entertainment device is adjacent a second lower side of the entertainment device.

Accordingly, it should be understood that the foregoing description of the embodiments has been provided for purposes of illustration and description, and that variations in configuration and operation should not to be regarded as a departure from the scope of the claimed invention. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known device structures and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "right," left," "upper," "lower," "above," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An interactive arrangement of entertainment devices, comprising:

at least two entertainment devices, each entertainment device having a first communication device on a first side and a second communication device on a second side of the entertainment device, which are configured to receive a limited range wireless signal from at least one other entertainment device when the at least two entertainment devices are adjacently arranged in a spaced apart manner in close physical proximity to each other, each entertainment device being configured to operate in a first mode of controlling the at least one other entertainment device or a second mode of being controlled by the at least one other entertainment device based on whether the other entertainment device is adjacent the first communication device on the first side or the second communication device on the second side of the entertainment device;

wherein each entertainment device is configured to transmit a wireless polling signal intended for at least one other entertainment device and to initiate operation in the first mode upon receiving a wireless signal from at least one other entertainment device indicating that at least one other entertainment device is adjacent a first right side of the entertainment device transmitting the wireless polling signal;

wherein each entertainment device is configured to initiate operation in the second mode upon receiving a wireless polling signal from at least one other entertainment device indicating that at least one other entertainment device is adjacent a left side of the entertainment device receiving the wireless polling signal;

wherein at least one entertainment device operating in the first mode initiates one or more wireless activation signals to control activation of an audio/visual element of at least one other entertainment device; and wherein the at least one other entertainment device operating in the second mode receives one or more wireless activation signals for an audio/visual element from at least one other entertainment device.

2. The interactive arrangement of entertainment devices of claim 1, wherein the audio/visual element of each entertainment devices comprises a light emitting device, and one entertainment device operable in the first mode is configured to initiate activation signals to control activation of its light emitting device and a light emitting device of at least one other entertainment device according to a timing sequence for generating a blinking light pattern over time.

3. The interactive arrangement of entertainment devices of claim 2, wherein the entertainment device configured to operate in the first mode is configured to initiate activation signals to control activation of its light emitting device and a light emitting device of at least one other entertainment device without actuation by a user of any user input button.

4. The interactive arrangement of entertainment devices of claim 1, wherein the audio/visual element of each of the entertainment devices comprises a speaker, and the entertainment device that is operable in the first mode is configured to transmit activation signals to control activation of its speaker and a speaker of at least one other entertainment device according to a timing sequence for generating a song or melody over time.

* * * * *